US005289883A

United States Patent [19]

Robinson

[11] Patent Number: 5,289,883

[45] Date of Patent: Mar. 1, 1994

[54] WELL CASING-CONTAINED BLOWOUT PREVENTER

[75] Inventor: Jerry H. Robinson, Mobile, Ala.

[73] Assignee: Wellcutter Inc., Brewton, Ala.

[21] Appl. No.: 963,487

[22] Filed: Oct. 21, 1992

[51] Int. Cl.[5] ..... E21B 33/06

[52] U.S. Cl. ..... 166/386; 166/82; 166/91; 166/100

[58] Field of Search ..... 166/54, 72, 84, 85, 166/89, 336, 386, 387

[56] References Cited

U.S. PATENT DOCUMENTS

| | | | |
|---|---|---|---|
| 2,009,888 | 7/1930 | Hild | 166/54 |
| 3,186,488 | 6/1965 | Johnson et al. | 166/95 |
| 3,848,669 | 11/1974 | Brown | 166/72 |
| 4,098,341 | 7/1978 | Lewis | 166/387 |
| 4,099,562 | 7/1978 | Mattoon | 166/84 |
| 5,092,401 | 3/1992 | Heynen | 166/89 |

*Primary Examiner*—Ramon S. Britts
*Assistant Examiner*—Frank S. Tsay
*Attorney, Agent, or Firm*—Nixon & Vanderhye

[57] ABSTRACT

Blowout preventers (BOP) include a tubular shell which is insertable within, and thus contained by, an upper portion of the well casing. The tubular shell includes a removable inner sealing/pressure-reducing (SPR) assembly which provides for a high-pressure seal against the exterior surface of the drill stem as well as reducing the pressure of rising subterranean gas. The SPR assembly includes a channel passageway for the rising subterranean gas in which a series of longitudinally separated transverse orificed baffles is disposed. In this manner, the pressure of the subterranean gas flowing upwardly through the channel passageways will be reduced as the gas encounters the orificed baffles. A longitudinally separated pair of split sealing blocks is also preferably disposed within the sealing/pressure-reducing assembly. The SPR assembly also most preferably includes sealing blocks are mounted for reciprocal transverse movements towards and away from the central bore of the BOP so as to be capable of movements into and out of sealing relationship with an exterior surface of a well stem. A rotary actuator system operatively coacts with the sealing blocks in such a manner that rotary motion of the actuator system is controllably translated into reciprocal lateral movements of the sealing blocks. As a result of such sealing, subterranean gas will be caused to flow through the channels and thereby pressure-reduced.

22 Claims, 9 Drawing Sheets

WELL CASING-CONTAINED BLOWOUT PREVENTER

FIELD OF INVENTION

This invention relates generally to apparatus employed in oil and/or gas exploration or production. More specifically, this invention relates to apparatus which are utilized at an oil and/or gas well site to prevent blowout conditions.

BACKGROUND AND SUMMARY OF THE INVENTION

During the exploration for fossil fuels, the drill will sometimes encounter a pocket or reservoir of high pressure (e.g., several thousand pounds per square inch (psi)) subterranean gas (such as steam, sulfite gas, natural gas or the like) which is then free to rise through the well casing. Of course, the uncontrolled release of such high pressure gas at the well head could cause severe damage to equipment and potential injury to the drilling crew. It is therefore typical for the well head to be provided with apparatus known in art-parlance as a blowout preventer (BOP) which minimizes the risk of such uncontrolled escape of high pressure gas.

Conventional BOP'S, however, are extremely large and cumbersome valving devices which are positioned above-ground directly on the well head. Furthermore, while conventional BOP's have a central bore to allow for passage of the drill stem during normal drilling operations, the drill stem must usually be physically stopped in the well casing when a pocket of high pressure subterranean gas is encountered. Stoppage of the drill stem within conventional BOP's allows the drilling crew to pump a viscous drilling fluid (known as "drilling mud") into the well, in addition to allowing the conventional BOP to close and function in its intended manner.

Once the gas has been effectively trapped at the top of the well casing between the BOP and the viscous drilling mud, the gas will then controllably be evacuated from the well head by an above-ground valving manifold (e.g., a so-called "choke-and-kill" manifold). The valving manifold includes several actuable valves which can be opened selectively so as to bleed the trapped high pressure gas from the top of the well casing in a controlled manner. Once the pressure within the top of the well casing is reduced to within acceptable limits, the BOP may again be opened, the drill stem reinserted into the well, and the drilling operation resumed.

Of course, it is quite time consuming (and thereby costly) to stop the drilling operation to allow for removal of high pressure gas each time a high pressure gas pocket is encountered. Additional significant costs are incurred in subterranean drilling for fossil fuel due to the relatively massive size of conventional BOP's and the auxiliary handling equipment (e.g., drilling rigs, hoists, heavy-duty motors and the like) needed to position the conventional BOP on the well head, and remove it for servicing/inspection. It would therefore be desirable if a reduced-size BOP was provided which could statically reduce the pressure of rising high pressure subterranean gases without necessarily requiring stoppage of the drilling operation. It is towards providing such a BOP that the present invention is directed.

Broadly, the blowout preventer (BOP) according to this invention is embodied in a tubular shell which is insertable within, and thus contained by, an upper portion of the well casing. The tubular shell includes a removable inner sealing/pressure-reducing assembly which provides for a high-pressure seal against the exterior surface of the drill stem as well as reducing the pressure of rising subterranean gas. In this regard, the sealing/pressure-reducing assembly includes a channel passageway for the rising subterranean gas. Most preferably, the channel passageway is in the form of a segment of a right cylinder which is established collectively by a longitudinal side wall of the sealing/pressure-reducing assembly and an interior cylindrical surface of the tubular shell within which the sealing/pressure-reducing assembly is seated. A series of orificed baffles is disposed transversely within the channel passageway with the individual baffles being longitudinally spaced-apart from one another so as to define pressure-reducing chambers between adjacent baffle pairs. In this manner, the pressure of the subterranean gas will be reduced as the gas flows upwardly through the channel.

A longitudinally separated pair of split sealing blocks is also preferably disposed within the sealing/pressure-reducing assembly. The sealing blocks are mounted for reciprocal lateral movements towards and away from the central bore of the BOP according to this invention so as to be capable of movements into and out of sealing relationship with an exterior surface of the well stem. A rotary actuator system operatively coacts with the sealing blocks in such a manner that rotary motion of the actuator system is controllably translated into reciprocal lateral movements of the sealing blocks.

The BOP according to this invention is thus capable of providing a high-pressure sliding seal with the exterior surface of the drill stem while also allowing substantial pressure reduction of the rising subterranean gas to occur statically by means of the static orificed baffles disposed in the channel passageway. In this manner, the dangers associated with the uncontrolled escape of high-pressure subterranean gas is significantly reduced (if not virtually eliminated) by the BOP of this invention while avoiding necessary stoppage of the drilling operation during such gas pressure reduction.

Further aspects and advantages of this invention will become more clear after careful consideration is given to the following detailed description of the preferred exemplary embodiments thereof.

BRIEF DESCRIPTION OF THE ACCOMPANYING DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
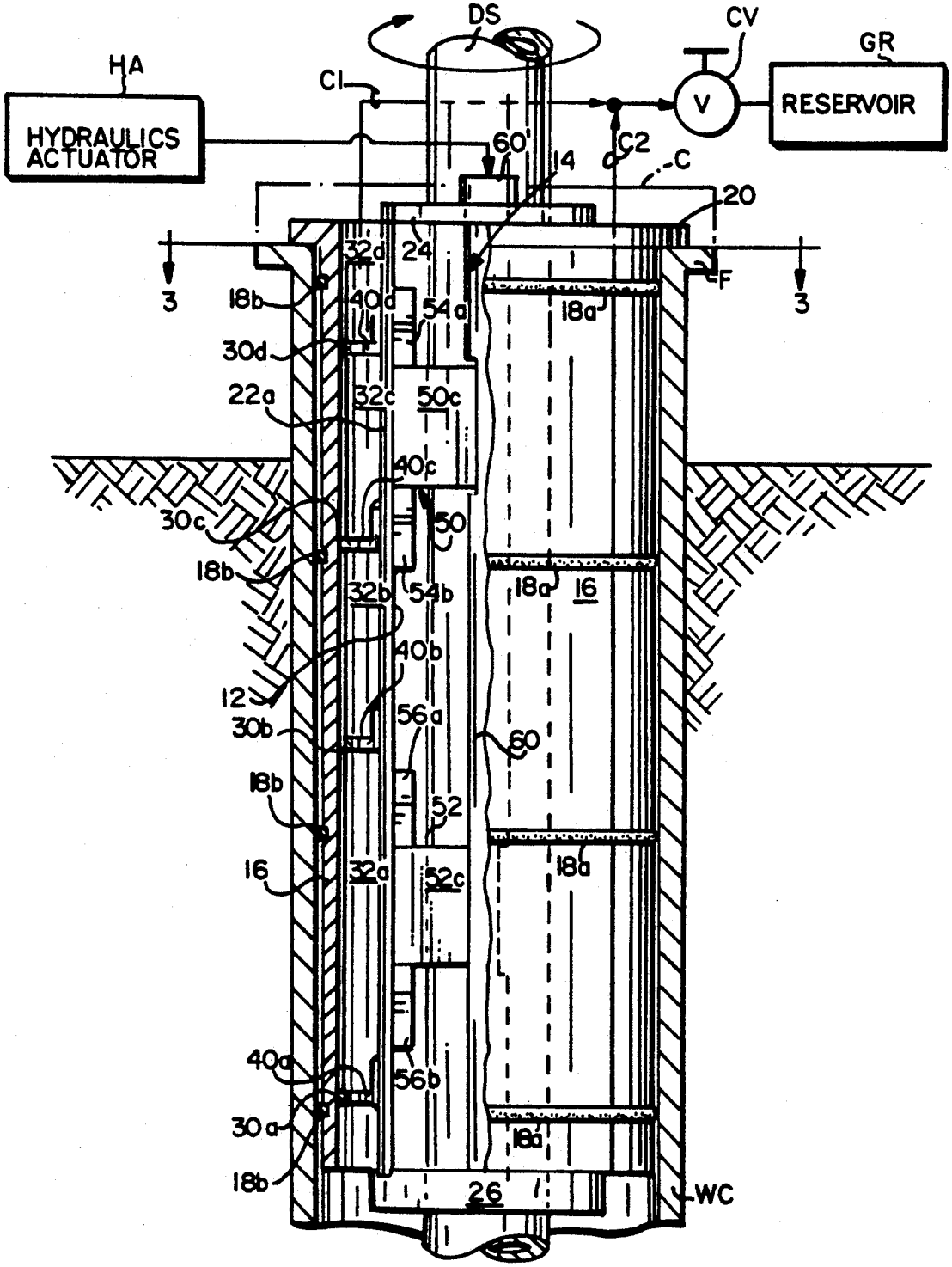
FIG. 1 is a cross-sectional elevational view depicting an embodiment of the blowout preventer according to this invention positioned within a typical well casing.
Figure 2:
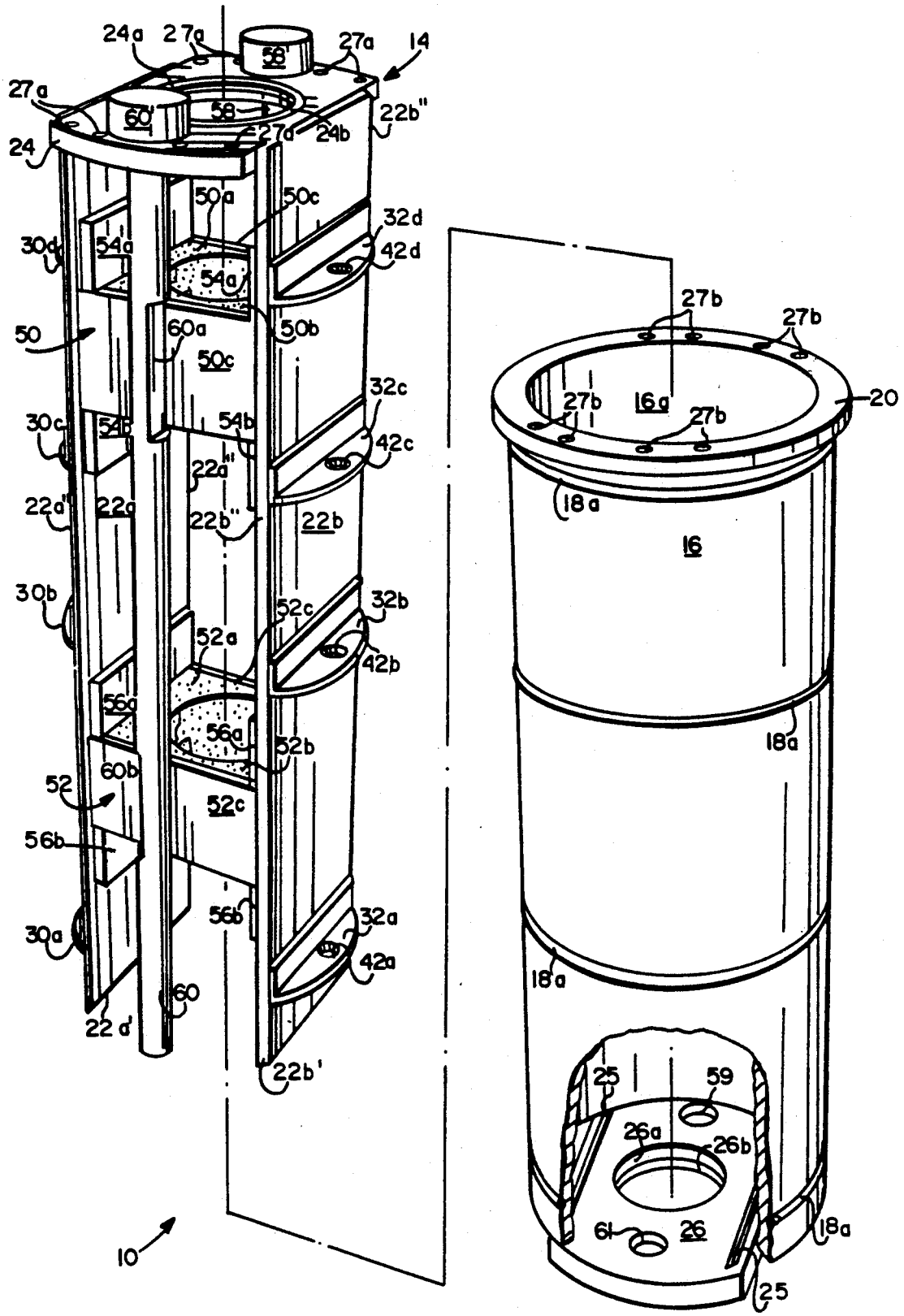
FIG. 2 is an exploded perspective view, partly in section, showing the component structures of the blowout preventer according to this invention.
Figure 3:
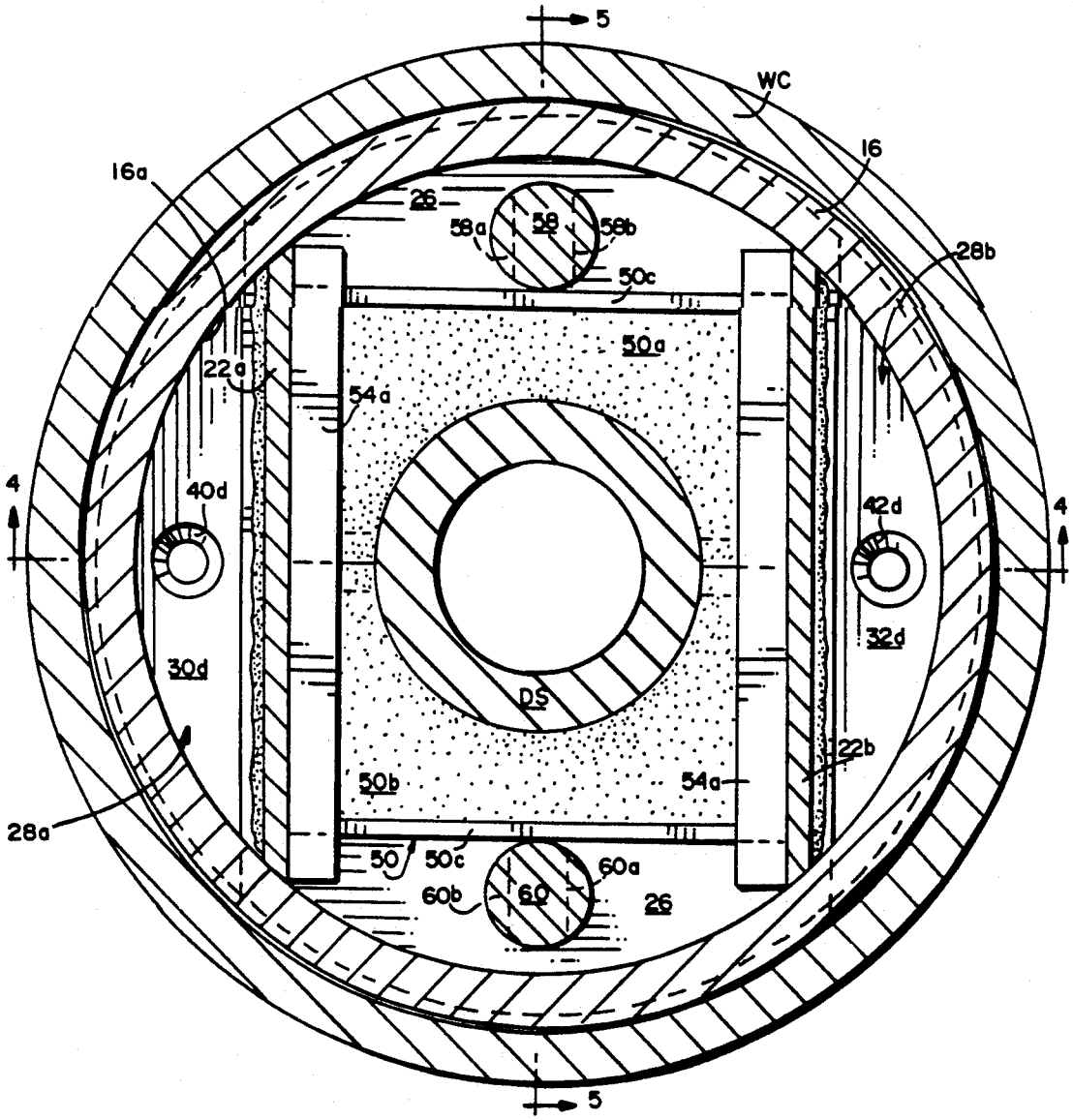
FIG. 3 is a latitudinal cross-sectional view of the blowout preventer according to this invention as taken along line 3—3 in FIG. 1.
Figure 4:
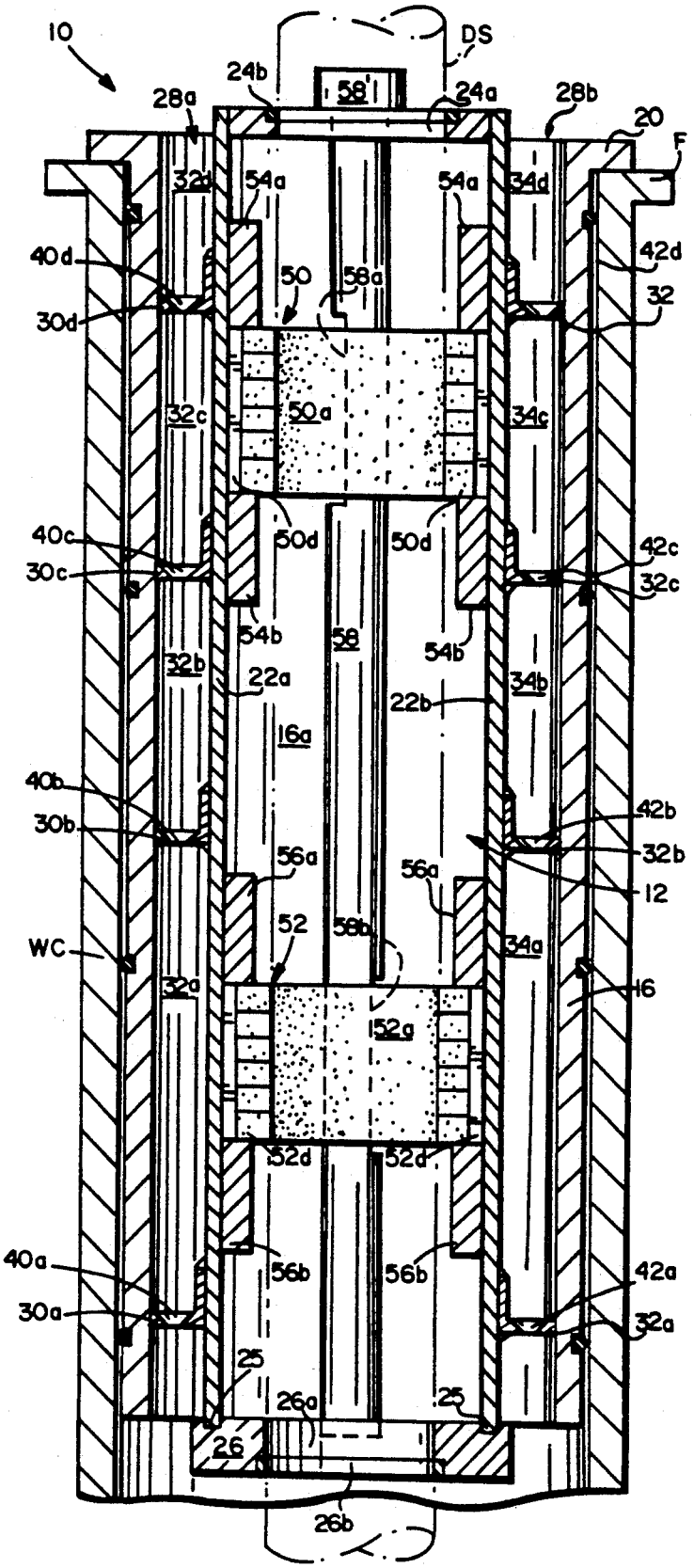
FIG. 4 is a longitudinal cross-sectional view of the blowout preventer as taken along line 4—4 in FIG. 3.

Accompanying FIGS. 1 and 2 depict a preferred embodiment of a blowout preventer (BOP) 10 according to this invention. In this connection, FIG. 1 shows the BOP 10 operatively positioned within the upper end of a well casing WC during a drilling operation whereby a drill stem DS (whose terminal end is coupled to a suitable bit (not shown)) extends through the central bore 12 defined within the sealing/pressure reducing assembly 14 (hereinafter more simply referred to as the "SPR assembly") of the BOP 10.

The SPR assembly 14 is concentrically seated longitudinally within the outer tubular shell 16, which in turn is concentrically positioned longitudinally within the well casing WC. The shell 16 is preferably machined from monolithic tubular steel so as to withstand the requisite high-pressures that may be encountered during the drilling operation. Furthermore, additional beneficial high-pressure reinforcement of the BOP 10 is provided by the machined well casing WC since the shell 16 is itself disposed within, and laterally constrained by, the well casing WC. High-pressure O-ring seals 18*a* are preferably seated within a corresponding groove 18*b* in the exterior surface of the shell 16 so as to provide a high-pressure seal between the shell 16 and the interior surface of the well casing WC. It will be understood, however, that only a slight clearance space is provided between the exterior surface of the shell 16 and the interior surface of the well casing WC sufficient to allow the BOP 10 to be inserted within, and withdrawn from, the well casing WC.

The BOP 10 is rigidly mounted to the upper end of the well casing WC by any suitable clamping structures designed to withstand the potential high-pressures to be encountered during use. For example, in the embodiment shown, the BOP 10 is dependently supported within the well casing WC by a mounting flange 20 which is rigidly coupled to the flange F of the well casing WC by means of a high-pressure clamp C. High pressure clamp C could be any suitable structure, such as a hydraulic and/or electrically-operated clamp, high-pressure flange/bolt assembly or the like.

The components of the SPR assembly 14 are perhaps better seen in accompanying FIGS. 2–5. As is shown in FIG. 2, for example, the SPR assembly 14 includes an opposed pair of longitudinally oriented parallel side plates 22*a*, 22*b* rigidly joined at their upper edges to cap plate 24. The respective lower edges 22*a*', 22*b*' of the side plates 22*a*, 22*b* are received within grooves 25 (see FIG. 2) formed in the sole plate 26 which is rigidly connected (e.g., via welding) to the lower end of the tubular shell 16. The cap plate 24 and flange 20 associated with the tubular shell 16 are each provided with mated apertures 27*a*, 27*b* through which high pressure bolt/nut assemblies (not shown) may pass so as to rigidly secure the SPR assembly 14 within the tubular shell 16.

The lateral edges 22*a*'', 22*b*'' of the side plates 22*a*, 22*b*, respectively, are each machined so as to fit tightly against the interior surface 16*a* of the shell 16. As a result, longitudinally oriented channel passageways 28*a*, 28*b* are respectively established between the side plates 22*a*, 22*b* and a corresponding portion of the interior surface 16*a* of shell 16. (See FIG. 3, for example.) Furthermore, it will be observed that the channel passageways 28*a*, 28*b* are geometrically in the form of a segment of a right cylinder.

As mentioned previously, the drill stem DS extends through the central bore 12 of the SPR assembly 14. The cap and sole plates 24, 26 are thus provided with cylindrical bores 24*a*, 26*a*, respectively, which are sized so as to allow the drill stem DS (and any associated larger diameter drill stem couplers that may be used) to pass therethrough. The bores 24*a*, 24*b* may be provided with O-ring type seals 24*b*, 26*b* so as to facilitate the sealing of the drill stem DS by the SPR unit 14 as will be discussed in greater detail below.

Important to the present invention, the side plates 22*a*, 22*b* of the SPR assembly 14 each rigidly (e.g., by welding) include a series of orificed baffle plates 30*a*–30*d* and 32*a*–32*d*, respectively. As is shown in the accompanying drawings, each of the channel passageways 28*a*, 28*b* includes a series of four baffle plates 30*a*–30*d* and 32*a*–32*d*, respectively, but a greater/lesser number of such baffle plates could be provided depending upon the pressure-reducing functions that may be desired for a given end-use application. In addition, the spacing between any given pair of baffle plates may be greater/lesser as compared to the spacing between other pairs of baffle plates in the series. For example, in the embodiment shown, the longitudinal spacing dimension as between baffle plates 30*a*–30*b* and 32*a*–32*b* is almost double the longitudinal spacing dimension as between the other baffle plates 30*b*–30*d* and 32*b*–32*d*.

The baffle plates 30*a*–30*d* and 32*a*–32*d* are longitudinally spaced-apart from adjacent ones of the baffle plates in each of the channel passageways 28*a*, 28*b*, respectively. As a result, pressure reducing sub-chambers 34*a*–34*d* and 36*a*–36*d* (see FIG. 4) are established upstream of each of the baffle plates 30*a*–30*d* and 32*a*–32*d* relative to the flow direction of subterranean gas which enters the SPR assembly 14 at the bottom of each passageway 28*a*, 28*b* and exits at the top of SPR assembly 14 via flow-communication conduits C1, C2 (see FIG. 1). The subterranean gas which exits the last pressure reducing subchamber 34*d*, 36*d* will thus be at a pressure suitable for transfer to a gas reservoir GR via a control valve CV for storage and/or further treatment.

Each of the baffle plates 30*a*–30*d* and 32*a*–32*d* is provided with an orifice 40*a*–40*d* and 42*a*–42*d*, respectively, each of which includes a smaller diameter upstream (as determined by the flow of subterranean gas therethrough) entrance edge and a bevelled (e.g., 45°) conical surface segment extending downstream from the entrance edge. As the flow of high-pressure subterranean gas enters the channel passageways 28*a*, 28*b*, it will sequentially pass through the orifices 40*a*–40*d* and 42*a*–42*d* formed in the baffle plates 30*a*–30*d* and 32*a*–32*d*, respectively. As a result of the flow constrictive orifices 40*a*–40*d* and 42*a*–42*d*, the velocity of the gas will increase while the gas pressure will be reduced. Thus, the gas pressure will be reduced in a step-wise manner as it flows sequentially through the orifices 40*a*–40*b* and 42*a*–42*b* and into the upstream chambers 34*a*–34*d* and 36*a*–36*d*, respectively.

The channel passageways 28*a*, 28*b* and orifices 40*a*–40*d* are most preferably sized so as to provide a pressure drop which reduces the subterranean gas by a factor of $10^2$ (e.g., 15,000 psi to 150 psi). In order to achieve such pressure drops, a number of BOP's 10 may need to be connected coaxially to one another in sequence and then placed within the well casing WC as described earlier. Alternatively, a BOP 10 having a greater longitudinal dimension (and hence a larger number of baffle plates/orifices) could be provided in dependence upon the well requirements.

The SPR assembly 14 also most preferably includes paired spaced apart sealing block subassemblies 50, 52, each of which is comprised of opposed longitudinally split seal blocks 50*a*, 50*b* and 52*a*, 52*b*, respectively, which are formed of a hard rubber-like material (e.g., EPDM rubber or the like). The seal blocks 50*a*, 50*b* and 52*a*, 52*b* are most preferably bonded to metal (e.g., stainless steel) back plates 50*c*, 52*c* and side plates 50*d*, 52*d*, respectively.

The sealing block subassemblies 50, 52 are mounted adjacent to the interior of side plates 22*a*, 22*b* by opposed upper and lower guide blocks 54*a*, 54*b* and 56*a*, 56*b*, respectively, which are rigidly coupled (e.g., by welding) to one of the side plates 22*a*, 22*b*. The guide blocks 54*a*, 54*b* and 56*a*, 56*b* positionally capture the seal blocks 50*a*, 50*b* and 52*a*, 52*b* therebetween but allow each of the seal blocks 50*a*, 50*b* and 52*a*, 52*b* to be slidably moved reciprocally towards and away from the drill stem DS. The opposed terminal end faces of each of the seal blocks 50*a*, 50*b* and 52*a*, 52*b* are each preferably digitated so as to mate with one another when the seal blocks 50*a*, 50*b* and 52*a*, 52*b* are in their closed or sealing position to thereby improve the sealing effect against the exterior surface of the drill stem DS. However, a butt joint or other mating configurations for the seal blocks 50*a*, 50*b* and 52*a*, 52*b* when in their closed or sealing position could also be provided.

The seal blocks 50*a*, 52*a* and 50*b*, 52*b* are transversely moved relative to the drill stem DS by longitudinally oriented rotary actuator rods 58, 60, respectively. The lower ends of the actuator rods 58, 60 are received within a respective bearing recess 59, 61 formed in the sole plate 26 (see FIG. 2), while the upper ends of the actuator rods 58, 60 extend through the upper cap plate 24 and terminate in a suitable actuator head 58', 60'. The actuator heads 58', 60' may be in the form of a gear, hex-head, or like configuration which may be operatively coupled to a suitable hydraulic actuator HA (see FIG. 1) which forcibly rotates the actuator rods 58, 60 in a selected direction (e.g., clockwise as viewed in FIG. 3). Alternately, the actuator rods 58, 60 may be forcibly rotated by any suitable mechanical and/or electrical actuation means.

Figure 5:
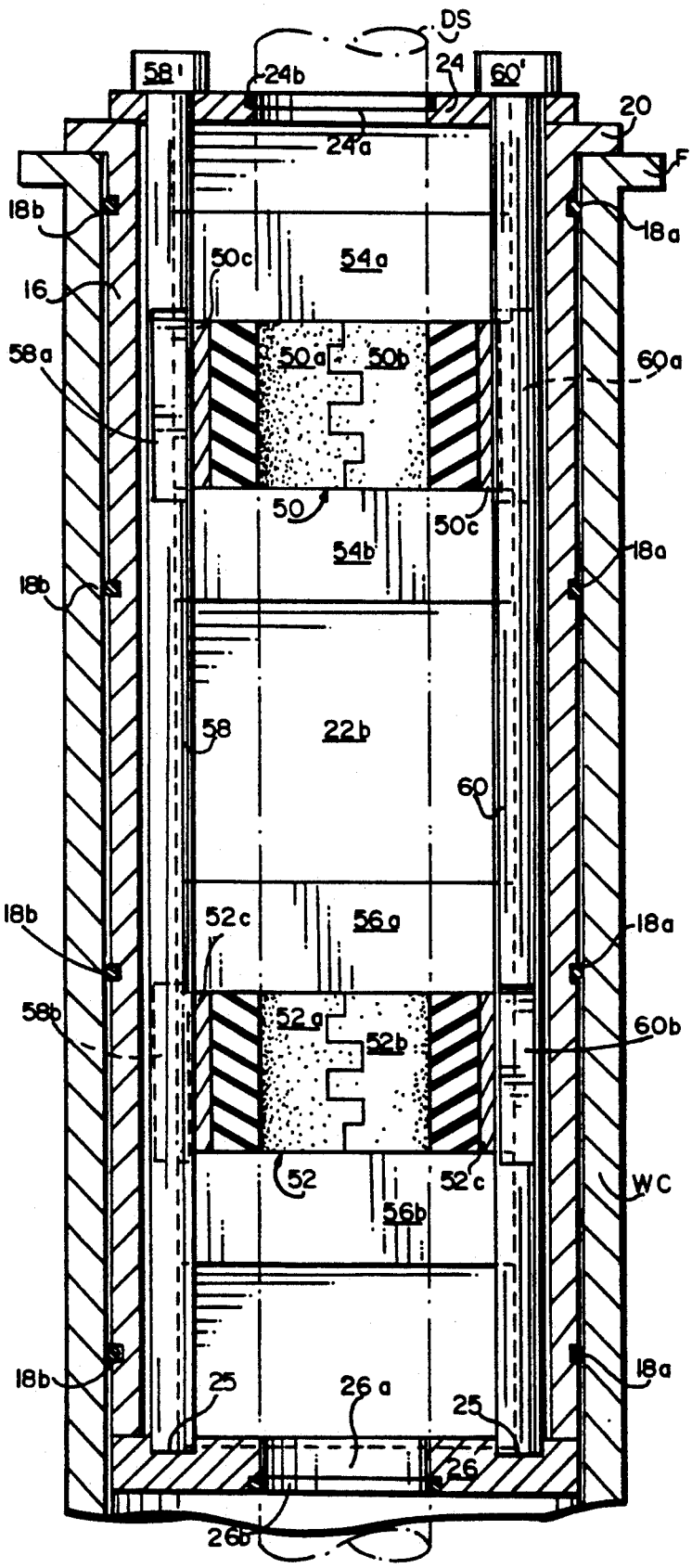
FIG. 5 is another longitudinal cross-sectional view of the blowout preventer according to this invention as taken along line 5—5 in FIG. 3.

As is perhaps best seen in FIG. 5, portions of the actuator rods 58 and 60 bear against the metal back plates 50*c*, 52*c* and 50*d*, 52*d* of seal blocks 50*a*, 52*a* and 50*b*, 52*b*, respectively. It will also be observed that the actuator rods 58, 60 include upper and lower longitudinal recessed segments 58*a*, 60*a* and 58*b*, 60*b* which are in horizontal alignment with-the metal back plates 50*c*, 52*c* and 50*d*, 52*d* of seal blocks 50*a*, 52*a* and 50*b*, 52*b*, respectively. The upper and lower recessed segments 58*a*, 60*a* and 58*b*, 60*b* are, however on opposite sides of the rods 58, 60 (i.e., are preferably 180° out of phase with one another). Thus, as the actuator rods 58, 60 rotate, the upper and lower recessed segments 58*a*, 60*a* and 58*b*, 60*b* will be moved into and out of adjacent facing relationship with the back plates 50*c*, 52*c* and 50*d*, 52*d* of the seal blocks 50*a*, 52*a* and 50*b*, 52*b*. The individual seal blocks 50*a*, 52*a* and 52*a*, 52*b* are thus capable of being slidably moved laterally away from the drill stem DS when the respective upper and lower recessed segments 58*a*, 60*a* and 58*b*, 60*b* are brought into facing alignment with a respective one of the back plates 50*c*, 52*c*.

On the other hand, upon continued rotation of the actuator rods 58, 60 such that the recessed segments 58*a*, 60*a* and 58*b*, 60*b* no longer are in facing relationship with a respective one of the back plates 50*c*, 52*c* and 50*d*, 52*d* of the seal blocks 50*a*, 52*a* and 50*b*, 52*b*, the exterior surface of the rods 58, 60 will serve as a cam so as to forcibly cause the seal blocks 50*a*, 52*a* and 50*b*, 52*b* to slide towards the drill stem DS. In this manner, rotary motion of the actuator rods 58, 60 is translated into reciprocal transverse sliding movements of the seal blocks 52*a* and 50*b*, 52*b* towards and away from the drill stem (i.e., between sealing and non-sealing positions).

The functional attributes of the SPR assembly 14 described above is especially advantageous to maintain sealing contact with the drill stem DS in the event that pipe coupling or the like having a somewhat larger diameter as compared to the drill stem DS is raised/-lowered into the well through the BOP 10 according to this invention. Accompanying FIGS. 6–9 depict in sequence the preferred operation of the SBR assembly 14 in such a situation.

Figure 6:
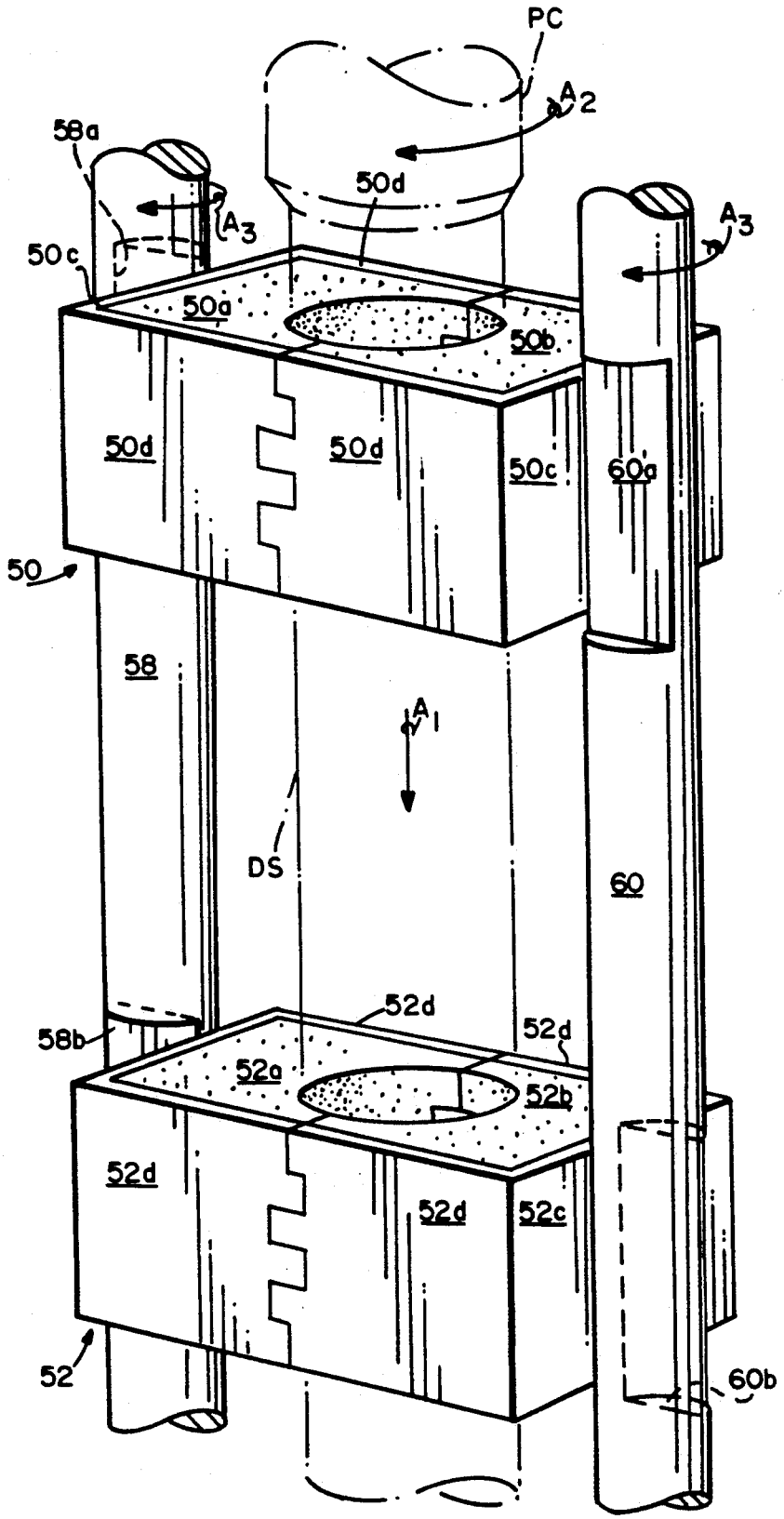
FIGS. 6–9 are each a perspective elevational view of the sealing blocks and associated rotary actuators and sequentially show the functional interaction therebetween.

As is depicted in FIG. 6, the drill stem DS having a pipe coupling PC therein (i.e., so as to couple adjacent lengths of drill stem DS together) is being lowered into the well (arrow $A_1$) while also being rotated (Arrow $A_2$). At this time, it will be noted that the seal blocks 50*a*, 50*b* and 52*a*, 52*b* associated with each of the sealing subassemblies 50 and 52, respectively, are in a closed or sealing position with respect to the drill stem. Just prior to the pipe coupling PC encountering the seal block assembly 50, the actuator rods 58, 60 are rotated (arrows $A_3$) a one-quarter turn so as to present their respective recessed segments 58*a*, 60*a* in facing relationship with the back plates 50*c*, 50*d* of the seal blocks 50 as shown in FIG. 7.

Figure 7:
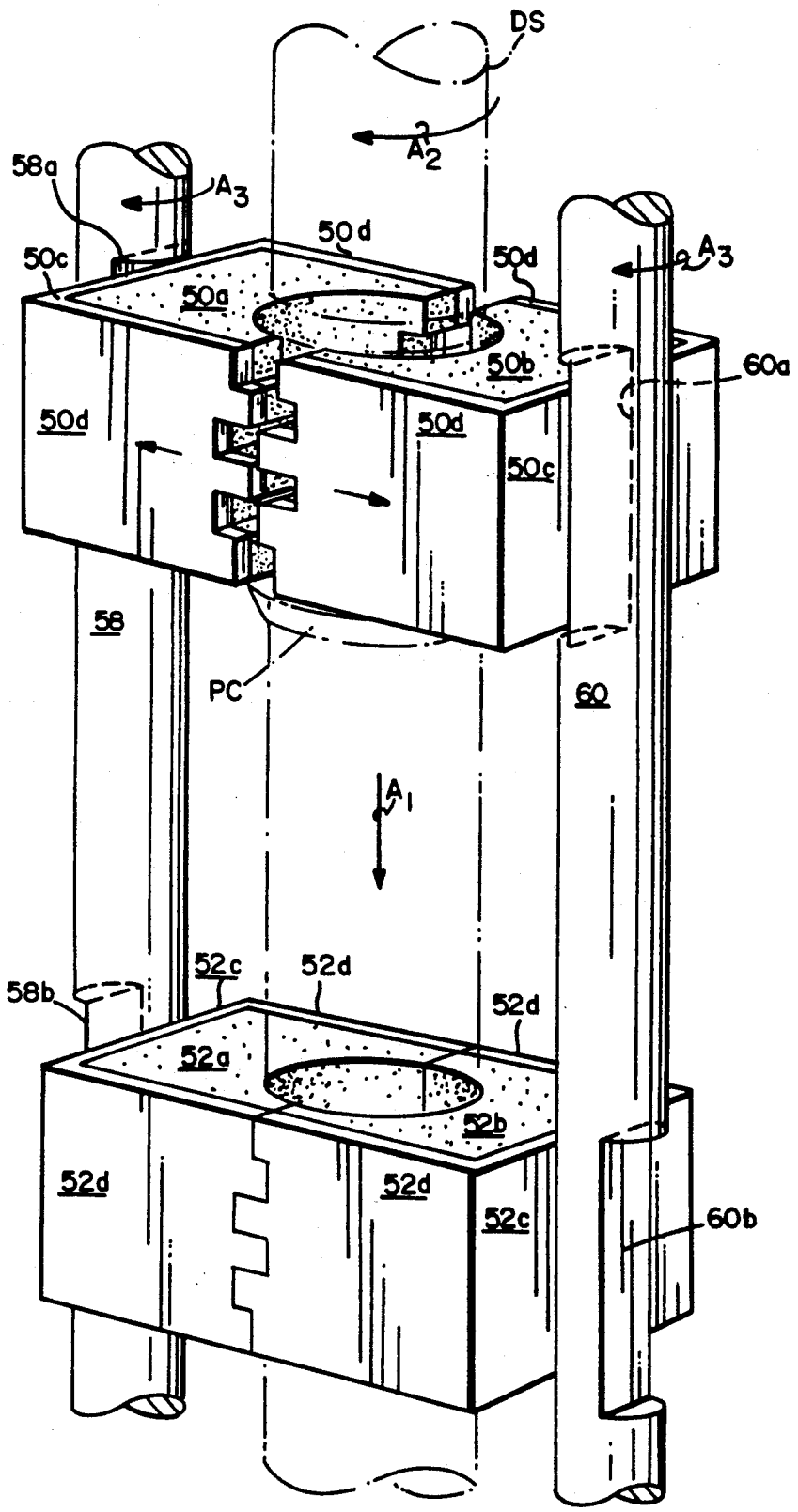

Once the recessed segments 58*a*, 60*a* are in facing relationship to the back plates 50*c*, 50*d* of the seal blocks 50*a*, 50*b* as shown in FIG. 7, the continued downward movement of the pipe coupling PC will forcibly spread the seal blocks 50*a*, 50*b* by a distance equal to the radial recessed dimension of the recessed segments 58*a*, 60*a* which is sufficient for the pipe coupling to pass therethrough. Upon the pipe coupling clearing the seal blocks 50*a*, 50*b*, the actuator rods 58, 60 are again rotated one-quarter turn so that the recessed segments 58*a*, 60*a* move out of facing relationship with the back plates 50*c* of seal blocks 50*a*, 50*b*. As a result, the back plates 50*c* are again contacted by the exterior surfaces of the actuator rods 58, 60 which serve to cam the seal blocks 50*a*, 50*b* towards one another to their closed state as shown in FIG. 8.

Figure 8:
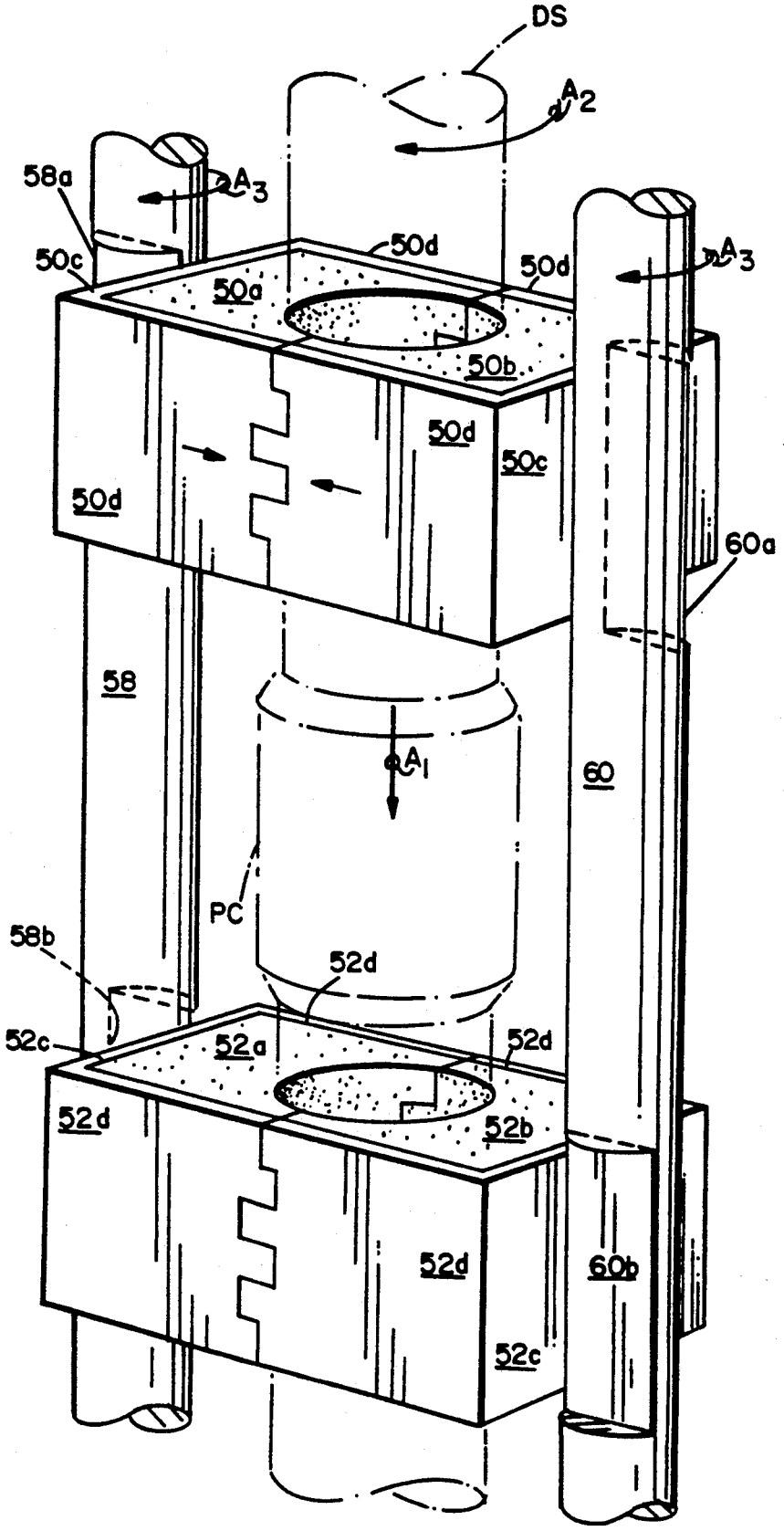
Figure 9:
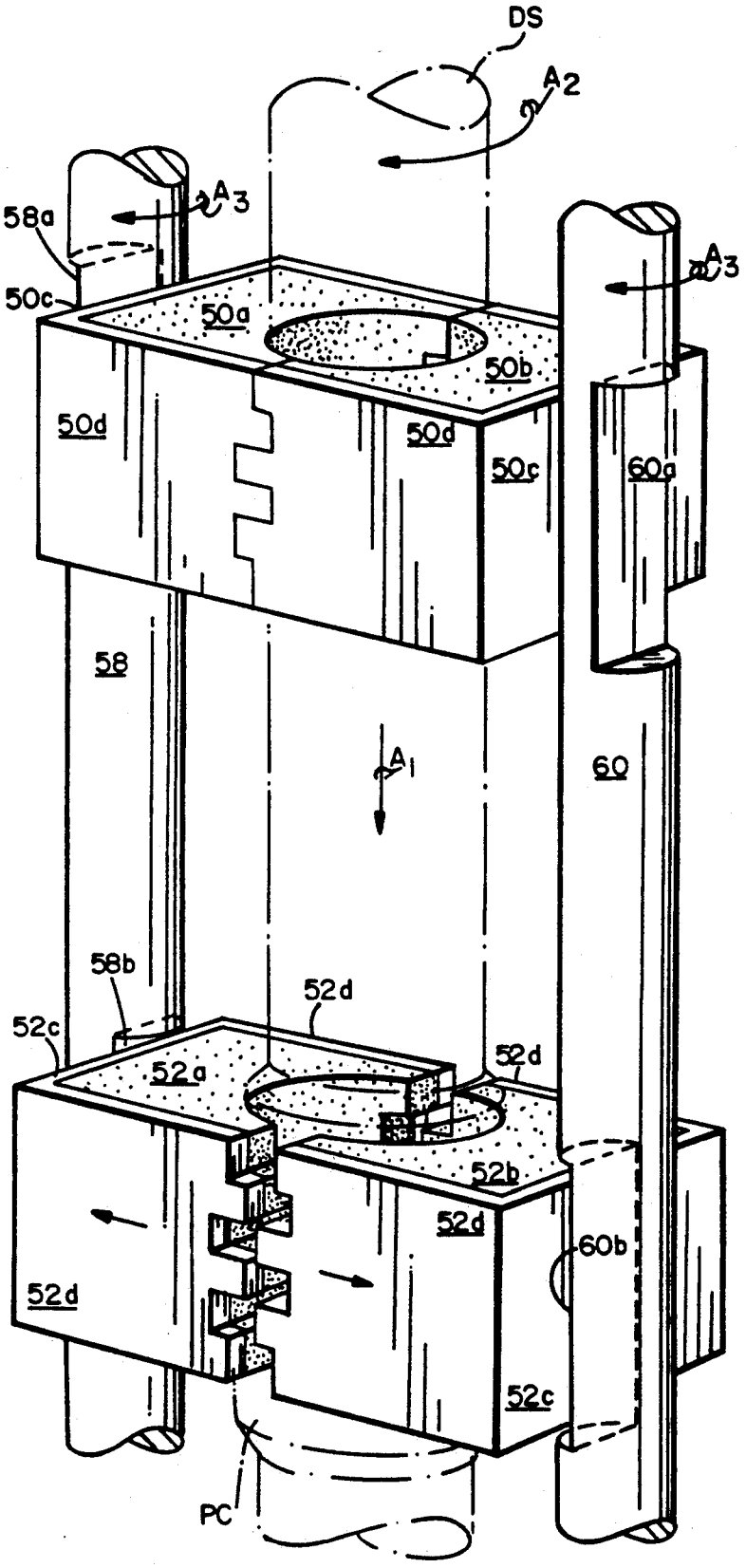

As will also be appreciated from FIG. 8, the turning movements of the actuator rods 58, 60 described above will cause the lower recessed segments 58*b*, 60*b* to be moved into a "ready" position where a further one-quarter turn of the rods 58, 60 will bring them into facing relationship to the back plates 52*c* of the seal blocks 52*a*, 52*b*. Thus, since the pipe coupling PC in its position as depicted in FIG. 8 is required to clear the seal blocks 52*a*, 52*b*, the actuator rods 58, 60 are rotated another one-quarter turn so that the recessed segments 58*b*, 60*b* are brought into facing relationship with the back plates 52*c* of seal blocks 52*a*, 52*b*. As a result, the downward movement of the pipe coupling PC causes the seal blocks 52a, 52b to laterally spread in a manner similar to that described above with respect to seal blocks 50a, 50b. Once the pipe coupling PC has cleared the seal blocks 52a, 52b, the actuator rods 58, 60 may be rotated another quarter turn so as to again close the seal blocks 52a, 52b and again achieve the seal block condition shown in FIG. 6. Of course, by operating the actuator rods 58, 60 in a reverse manner to that described above, the pipe coupling PC can be raised from the well without completely breaking the seal on the exterior surface of the drill stem DS.

The functions described above can be accomplished manually by operating a suitable turning tool connected to the actuator rod heads 58', 60'. Alternately, appropriate automated control can be exercised over the mechanical actuator means (e.g., the hydraulics actuator HA) that is coupled operatively to the actuator rod heads 58'60'.

Although not shown, the BOP 10 according to this invention could be provided with inlet/outlet ports through which drilling fluids may be introduced into the well casing WC. Preferably, such inlet/outlet ports are formed in the cap plate 24 and sole plate 26 and are located closely adjacent to the actuator rods 58, 60.

Thus, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A blowout preventer for an oil and/or gas well comprising:

a tubular outer shell which is positionable within and thus contained by a well casing associated with the oil and/or gas well; and a fluid-pressure reducing assembly concentrically disposed within and rigidly coupled to said tubular outer shell, said fluid-pressure reducing assembly including (i) at least one longitudinally oriented plate which establishes a channel with a corresponding interior surface portion of said tubular outer shell to allow passage of fluid rising within the well casing; and (ii) a series of longitudinally separated orificed baffles disposed in said channel to reduce pressure of fluid passing through said established channel.

2. A blowout preventer as in claim 1, further comprising a sealing assembly which is movable into and out of sealing relationship with an exterior surface of a drill stem passing through said tubular shell.

3. A blowout preventer as in claim 2, wherein said sealing assembly includes a longitudinally spaces apart upper and lower seal block assemblies leaving opposed seal blocks.

4. A blowout preventer as in claim 3, wherein said sealing assembly includes mounting structure which mounts said seal blocks of said upper and lower seal block assemblies for transverse reciprocal movements towards and away from the drill stem.

5. A blowout preventer as in claim 4, wherein said sealing assembly includes a rotary actuator which coacts with said seal blocks of said upper and lower seal block assemblies such that rotary movement of said actuator is translated into said transverse reciprocal movements of said seal blocks towards and away from said drill stem.

6. A blowout preventer as in claim 5, wherein said rotary actuator includes cam surfaces which move said seal blocks towards and away from said drill stem in response to rotary movement of said actuator.

7. A blowout preventer as in claim 6, wherein said cam surfaces include upper and lower recesses formed in said rotary actuator at a position so as to be aligned with said seal blocks of said upper and lower sealing assemblies, respectively.

8. A blowout preventer as in claim 7, wherein said upper and lower recesses are 180° out of phase with one another.

9. A blowout preventer as in claim 1, wherein said at least one channel is a segment of a right cylinder.

10. A blowout preventer as in claim 9, wherein said baffles include a single orifice, and wherein said baffles are segmented circular plates corresponding to a cross-section of said channel.

11. A blowout preventer as in claim 1, wherein said orificed baffles include an orifice having a circular entranceway, and a conical surface extending from said entranceway.

12. A blowout preventer comprising:

a cylindrical outer shell positionable within an upper end of a well casing; and a sealing/pressure reducing assembly concentrically disposed within said outer shell for providing a seal with an exterior surface of a drill stem and for reducing pressure of subterranean gas rising through the well casing; wherein said sealing/pressure reducing assembly includes:

(i) an upper cap plate and a lower sole plate rigidly joined to upper and lower edges of said outer shell;

(ii) a pair of opposed side plates joined at each end to a respective one of said upper cap plate and said lower sole plate and establishing a pair of segmented cylindrical channels with a corresponding interior surface of said outer shell (iii) a number of longitudinally separated baffle plates transversely disposed within said segmented cylindrical channels, each of said baffle plates including a pressure-reducing orifice; and (iv) a sealing subassembly including sealing blocks movable into sealing relationship with the exterior surface of the drill stem such that pressurized subterranean gas rising within the well casing is caused to flow into said channels and through the orifices of said baffle plates, whereby the pressure of said subterranean gas is reduced.

13. A blowout preventer as in claim 12, wherein said sealing subassembly includes longitudinally spaced-apart upper and lower seal structures each having an opposed pair of said seal blocks.

14. A blowout preventer as in claim 13, wherein said sealing subassembly includes slide mounts which mount said opposed seal blocks of said upper and lower seal block structures for transverse reciprocal sliding movements towards and away from the drill stem.

15. A blowout preventer as in claim 14, wherein said sealing subassembly includes a rotary actuator which coacts with said opposed seal blocks of said upper and lower seal block structures such that rotary movement of said actuator is translated into said transverse reciprocal movements of said seal blocks towards and away from said drill stem.

16. A blowout preventer as in claim 15, wherein said rotary actuator includes cam surfaces which move said seal blocks towards and away from said drill stem in response to rotary movement of said actuator.

17. A blowout preventer as in claim 16, wherein said cam surfaces include upper and lower recesses formed in said rotary actuator at a position so as to be aligned with said seal blocks of said upper and lower sealing structures, respectively.

18. A blowout preventer as in claim 17, wherein said upper and lower recesses are 180° out of phase with one another.

19. A blowout preventer as in claim 12, wherein said baffle orifices include a circular entranceway, and a conical surface extending from said entranceway.

20. A method of reducing pressure of subterranean gas rising within a well casing without removing a drill stem therefrom comprising the steps of:

(a) establishing at least one longitudinally oriented channel passageway within the well casing laterally of the drill stem which has a number of longitudinally separated static pressure reducing orificed baffles transversely disposed therein;

(b) sealing the well casing between the drill stem and said at least one longitudinally oriented channel to cause said rising gas to flow through said channel; and (c) reducing the pressure of the subterranean gas in a step-wise manner by allowing the gas to flow sequentially through orifices of the pressure reducing orificed baffles.

21. A method as in claim 20, wherein step (b) is practiced by moving an opposed pair of seal blocks into sealing relationship with the drill stem.

22. A method as in claim 21, wherein step (b) is further practiced by rotating longitudinally disposed actuator rods which coact with said seal blocks, and then translating rotation of said actuator rods into transverse movement of said seal blocks.

* * * * *